United States Patent [19]

Hirano et al.

[11] 3,935,130

[45] Jan. 27, 1976

[54] DETERGENT COMPOSITION FOR CLEANING BATHTUBS

[75] Inventors: Satoshi Hirano, Fujieda; Jusha Tsumura; Izumi Imaseki, both of Tokyo; Yoshimi Kawasaki, Fujieda, all of Japan

[73] Assignee: Kabushiki Kaisha Tsumura Juntendo, Tokyo, Japan

[22] Filed: July 12, 1973

[21] Appl. No.: 378,640

[30] Foreign Application Priority Data

July 19, 1972 Japan ..... 47-71629

[52] U.S. Cl. ..... 252/542; 252/106; 252/545; 252/546; 252/559; 252/DIG. 7; 252/DIG. 14

[51] Int. Cl.[2] ..... C11D 1/94

[58] Field of Search ..... 252/542, 545, 546, 559, 252/DIG. 7, DIG. 10, DIG. 14

[56] References Cited

UNITED STATES PATENTS

| | | | |
|---|---|---|---|
| 2,551,634 | 5/1951 | Price | 252/153 X |
| 2,773,068 | 12/1956 | Mannheimer | 252/542 X |
| 2,950,255 | 8/1960 | Goff | 252/542 |
| 3,118,842 | 1/1964 | Besser | 252/542 X |
| 3,303,138 | 2/1967 | DeWitt et al. | 252/559 X |
| 3,400,198 | 9/1968 | Lang | 252/542 X |
| 3,591,509 | 7/1971 | Parks et al. | 252/546 X |
| 3,663,445 | 2/1972 | Augustin et al. | 252/548 X |
| 3,709,838 | 1/1973 | Mausner et al. | 252/559 X |
| 3,812,041 | 5/1974 | Inamorato | 252/89 |

*Primary Examiner*—Herbert B. Guynn
*Attorney, Agent, or Firm*—Haseltine, Lake & Waters

[57] ABSTRACT

A detergent composition for bathtub cleaning which needs little rubbing of the tub, and which comprises:

1. 100 parts by weight of a detergent base comprising surfactants:

| | parts by weight |
|---|---|
| anionic | 40 – 85 |
| nonionic | 10 – 40 |
| amphoteric | 5 – 20 |

2. 9 to 30 parts by weight of an alkylene glycol alkyl ether, and
3. 2 to 15 parts by weight of an alkanolamine.

6 Claims, 1 Drawing Figure

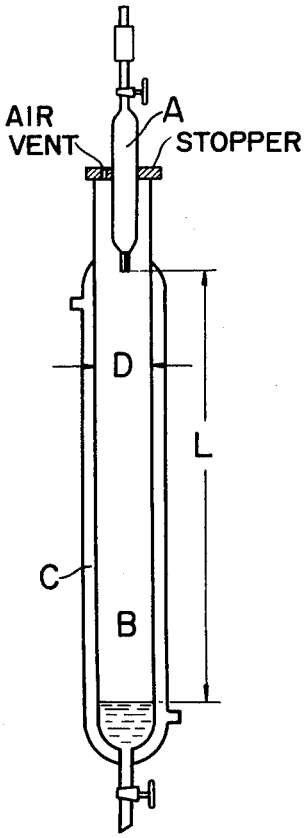
AIR
VENT
A
STOPPER
D
L
C
B

DETERGENT COMPOSITION FOR CLEANING BATHTUBS

BACKGROUND OF THE INVENTION

Generally, a detergent for use in removing grime on a bath tub wall is required to meet requirements different from that for the conventional detergents for tablewares, fabrics, etc. One reason for this is that the grime on a bathtub, that is, so-called scum or a bathtub ring, does not necessarily comprise only organic materials.

It is usually considered that the development of the scum in a bathtub may be attributable to stains from the skin and the fat of a human body, formation of an insoluble-lime soap through the use of a soap, inorganic and organic stains, and the like. Among them, the lime soap and the skin and fat grime of the human body are considerably sticky, and when they adhere to surfaces of a bathtub or a bath water heater of water recirculation type, it is difficult to remove.

In order to remove this grime completely with the use of conventional detergents, the work of rubbing heavily the surfaces of the bathtub with a scrubbing-brush, a sponge and the like is required and particularly the work of rubbing the bottom surface of a bathtub requires considerable labor and time.

Furthermore, with a bath water heater of water recirculation type installed outside the bathtub it is impossible to clean throughout the inner surface thereof due to its construction, and only clean cleaning grime out by means of hydraulic pressure provided through ports in communication with the outside is possible, so that no satisfactory effect of cleaning is obtained and the scum gradually accumulates to float out into the bathtub during bathing whereby those having a bath will feel uncomfortable. Such accumulation and floatation of scum must be avoided also from the standpoint of sanitation.

In addition to these problems, when these detergents are used for cleaning a bathtub, they are further unsatisfactory in sudsing, permeability, deodorizing ability, etc.

In cleaning a bathtub, the efficiency of cleaning work depends greatly upon sudsing and the time until the suds disappear which in turn govern the ease and time for rinsing and draining. In order to remove the scum adhering to a bathtub, a detergent should have a strong permeability and solubilization and at the same time should perform the function of removing bad odor resulting from the grime such as scum. That is, a detergent suitable for use for bathtub cleaning is one that has a good sudsing property, a short desudsing time, and strong deodorization and permeability.

Most of the detergents which have heretofore been used for bathtub cleaning comprise abrasives, and the cleaning of the tub has been conducted by a physical operation of rubbing the surface of the tub. As a result, the surface of the tub is liable to be scratched and the cleaning work is troublesome.

Detergents for cleaning toilet ceramic products such as a water closet may be also used for washing the tub, but these detergents are strongly acidic and the rubbing operation using a sponge directly containing these detergents has the great possibility of roughening the user's hands and has a tendency to deteriorate the materials of which the bathtub and bath water heater are made.

SUMMARY OF THE INVENTION

The present invention provides a detergent composition which meets the various requirements for cleaning bathtubs and bath water heaters as mentioned above. The detergent composition according to the present invention does not cause scratching of the materials of which the tube and the boiler are made because it is free of abrasives and can remove grime from the tub and the water heater without causing deterioration and corrosion of the tub and the water heater materials because it is weakly alkaline. Removal of the grime from the water heater will, of course, lead to improvement of thermal efficiency of water heater.

In accordance with the present invention, briefly summarized, there is provided a detergent composition for bathtub cleaning which comprises:

1. 100 parts by weight of a detergent base comprising 40 to 85% by weight of an anionic surface active agent, 10 to 40% by weight of a non-ionic surface active agent and 5 to 20% by weight of an amphoteric surface active agent;
2. 9 to 30 parts by weight of an alkylene glycol alkyl ether; and
3. 2 to 15 parts by weight of an alkanolamine.

The nature, principle, and utility of the present invention will be more clearly apparent from the following detailed description beginning with general aspects and features of the invention and concluding with specific examples of practice illustrating preferred embodiments of the invention.

BRIEF DESCRIPTION OF THE DRAWING

In the drawing, the single FIGURE is a schematic representation of a device for determining sudsing ability of a detergent.

DETAILED DESCRIPTION OF THE INVENTION

The present detergent composition for cleaning bathtubs comprises a detergent base [1] which comprises anionic, nonionic, and amphoteric surfactants and provides the composition with the basic detergency and a modifier [2 + 3] which provides the composition with improved capability of solubilizizng grime firmly adhering to the tub and the water heater.

Detergent base

Example of the surface active agents which may be used as the detergent base (1) in the present invention are as follows:

a. Anionic surface active agents

1. Alkylaryl sulfonates:

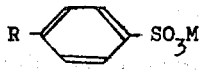

wherein $R_1$ is an alkyl radical having 8 to 14 carbon atoms and M is $NH_4$ or an ethanol amine selected from the group consisting of monoethanolamine, diethanolamine, and triethanolamine.

2. Higher alcohol sulfate ester salts:

$$R_1 . OSO_3M$$

wherein $R_1$ is a higher alcohol moiety having 8 to 18 carbon atoms and M is $NH_4$ or an ethanol amine selected from the group consisting of mono-, di-, and trethanolamines.

3. Alkyl sulfosuccinates:

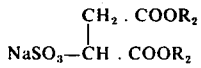

wherein $R_2$ is an alkyl radical having, for example 1 to 10 carbon atoms, e.g., isobutyl, amyl, hexyl, and 2-ethylhexyl.

4. Polyalkylene alkyl or aryl ether sulfate ester salts:

$$R_3\,(OCH_2CH_2)_n\,.\,OSO_3M$$

wherein $n$ is an integer from 2 to 10, $R_3$ is an alkyl radical having 8 to 14 carbon atoms or an aryl radical such as phenol or a tolyl, M is $NH_4$ or an ethanol amine selected from the group consisting of mono-, di-, and tri-ethanolamines.

5. Higher alkyl sulfonates:

$$R_4\,.\,SO_3M$$

wherein $R_4$ is a linear hydrocarbon having 11 to 18 carbon atoms and M is $NH_4$ or an alkali metal such as Na or K.

b. Nonionic surface active agents

1. Ethylene oxide addition products of higher alcohols:

$$R_5 - O\,(CH_2.CH_2O)_nH$$

wherein $R_5$ is a higher alcohol moiety having 12 to 18 carbon atoms, and n is an integer from 9 to 13.

2. Polyoxyethylenealkylarylethers:

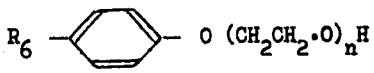

wherein $R_6$ is an alkyl radical having, for example, 4 to 16 carbon atoms, e.g., octyl, nonyl, dodecyl and an aryl radical such as phenol or a tolyl and n is an integer from 7 to 13.

3. Polyoxyethylene-polyoxypropylene block polymers:

i. Pluronic type

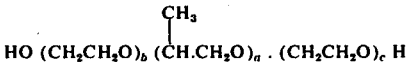

ii. Tetronic type

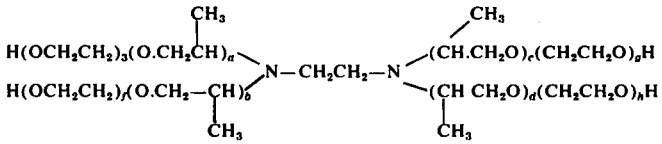

wherein the hydrophobic group (polypropylene glycol) used has a molecular weight of 950 to 2050 and the added ethylene oxide comprises 10 to 40 % by weight.

c. Amphoteric surface active agents

1. Cyclic imidiniums (Miranol)

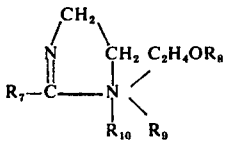

wherein $R_7$ is an aliphatic hydrocarbon having 7 to 17 carbon atoms, $R_8$ is H, an alkali metal such as Na, or K or $CH_2COOH$ $CH_2COONa$ or $CH_2COOK$, $R_9$ is $-CH_2COONa$, $-CH_2COOH$ or

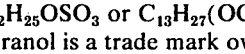

$R_{10}$ is OH,

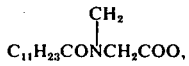

$C_{12}H_{25}OSO_3$ or $C_{13}H_{27}(OC_2H_4)_3OSO_3$.

Miranol is a trade mark owned by The Miranol Chemical Company Inc. for cyclic imidiniums disclosed in U.S. Pat. No. 2,773,068.

2. Alkylglycines $$R_{11} - (NHCH_2CH_2)_nN^+H\,CH_2COO-$$

wherein $R_{11}$ is an alkyl radical having 8 to 18 carbon atoms and $n$ is an integer from 1 to 3.

Several tests on the detergent base per se according to the present invention were conducted.

The compositions of the detergent bases used in these test are indicated in Table 1.

Table 1.

| Component | Sample A | B | C |
|---|---|---|---|
| Triethanolamine lauryl sulfate | 60% | 50% | 50% |
| Polyoxyethylenenonylphenol ether (10 E.O.) | 40% | 40% | 30% |
| Miranol C-2M CONC *1 | 0 | 10% | 20% |
| Total | 100% | 100% | 100% |

*1 Miranol C-2M CONC is a cyclic imidinium amphoteric surface active agent as described in U.S. Pat. No. 2,773,068.

1. Specific surface tension test

In this test the Samples A and B were subjected to Drop Weight Method to determine their surface tension, which was compared with that of water.

The Drop Weight Method

Traube's stalagmometer is used to calculate surface tension from the number of drops of liquid of given volume passing an orifice according to the equation:

$$\gamma_1/\gamma_2 = n_2\,\rho_1/n_1\rho_2$$

where:

$n_1$, $\rho_1$, and $\gamma_1$ are the number of drops, the density, and the surface tension of the liquid A which is water, respectively; $n_2$, $\rho_2$, and $\gamma_2$ are the number of drops, the density, and the surface tension of the liquid B which is the sample.

The results are shown in Table 2.

Table 2.

| Concentration | Sample A | B |
|---|---|---|
| 0.1% | 0.81 | 0.74 |
| 0.5 | 0.64 | 0.61 |
| 1.0 | 0.60 | 0.58 |

The results of this test show that the Sample B which contains the amphoteric surface active agent is effective particularly in a lower concentration.

2. Detergency test

Detergency was determined by the Reflectance Method.

In this test a test piece composed of the bathtub material was immersed in a bath and was exposed to the grime from the human body during bathing. The test piece thus soiled was then immersed in cleaning solutions, viz., diluted Samples A to C, for 60 minutes. At the end of the time, the test piece was removed therefrom, dried and subjected to the reflectance measurement. The reflectance was determined with reference, as a blank, to test pieces before the griming.

The data obtained are set forth in Table 3, in which a larger value indicates that the test piece has a closer gloss to the standard sample to which no grime adheres and that it is free of grime.

Table 3.

| Concentration | Sample A | B | C |
|---|---|---|---|
| 5 ml./180 l. water | 72.2% | 75.6% | 80.2% |
| 10 " | 75.6 | 87.2 | 87.2 |
| 15 " | 86.2 | 91.0 | 91.0 |
| 20 " | 91.0 | 92.0 | 93.0 |

The results of this test indicate that the Samples B and C which contain the amphoteric surface active agent are more effective particularly at a lower concentration than the Sample A which contains no amphoteric surface active agent.

A preferred combination of the surface active agents to prepare the detergent base used in the present invention comprises one or more anionic surface active agents in a quantity of 40 to 85%, preferably 50 to 80%, one or more nonionic surface active agents in a quantity of 10 to 40%, preferably 20 to 40%, and one or more amphoteric surface active agents in a quantity of 5 to 20%, preferably 10 to 20%, all % by weight of the detergent base. Preferably, particular surface active agents to be used in preparing the detergent base are so selected that they are compatible with the modifier [1 + 2], whereby no clouding and phase separation will occur when alkylene glycol alkyl ether [modifier 1] and alkanol amines [modifier 2] are incorporated in the detergent base in preparation of the present detergent composition for cleaning bathtubs. The compatibility can easily be determined by a simple test. In the case where occurrence of clouding and phase separation does not matter, no such preliminary test is necessary.

Modifier

Usually, a mixture of lime soap and fats deposits on the wall of a bathtub over a long period of time, and it is ordinarily difficult to remove such deposit by using conventional detergents.

We have now found that a composition comprising 100 parts by weight of the detergent base hereinabove described, 9 to 30 parts of an alkylene glycol alkyl ether and 2 to 15 parts of an alkanolamine dissolves and removes the accumulated and aged grime on the surfaces of a tub and a water heater with ease and, moreover, promotes the dissolution and dispersion of newly formed and lightly adhering grime. Further, the grime deposited on the interior surfaces of the water heater which are difficult to reach may be easily washed out with water containing the composition dissolved therein in a dilute concentration.

Alkylene glycol alkyl ethers used in the present invention have, for example, the following formula.

$$R_{12}-O-R_{13}-O-R_{14}$$

$$\begin{matrix} R_{12}-O-R_{13} \\ R_{14}-O-R_{13} \end{matrix} \Big\rangle O$$

wherein $R_{12}$ is a lower alkyl having 1 to 6 carbon atoms such as $CH_3$, $C_2H_5$, $C_3H_7$ and $C_4H_9$, and $R_{13}$ is a lower alkylene having 2 to 6 carbon atoms such as $C_2H_4$, $C_3H_6$ and $C_4H_8$, and $R_{14}$ is hydrogen or a lower alkyl having 1 to 6 carbon atoms such as methyl, ethyl, propyl, and butyl. When the above-mentioned alkylene glycol alkyl ether is added to the detergent base together with alkanol amine, the grime adhering to the bathtub and the water heater are easily separated and drained off.

The alkanolamines used in the present invention include, for example, lower alkanolamines such as those having the following formula;

$$(CH_2CH_2OH).NH_2$$
$$(CH_2CH_2OH)_2.NH$$
$$(CH_2CH_2OH)_3.N$$
$$(CH_2CHOH.CH_2)_3.N,$$

those having 2 to 9 carbon atoms in total being particularly preferable.

Another group of alkanolamines consisting of substituted alkanol amines such as those having the following formula may be also used.

$$(CH_2CH_2OH)\ NH.D$$
$$(CH_2CH_2OH)_2N.D$$

wherein D is an alkyl radical having 2 to 4 carbon atoms. Those having 3 to 9 carbon atoms are preferable.

Thus, alkanolamines which are represented by the following formula are preferable.

$$(HO-X)_nN-D_m,$$

where X is a linear or branched alkylene having 2 to 4 carbon atoms; D is an alkyl having 1 to 4 carbon atoms; $n$ is 1, 2 or 3; $m$ is 0, 1 or 2, $n+m$ being 3; and the total number of carbon atoms is 2 to 9.

In accordance with the present invention, with less than 9 parts alkylene glycol akyl ether added to 100 parts of the detergent base, the results are unsatisfactory. On the other hand, with more than 30 parts, hand chap is caused due to its strong degreasing function and a painted surface which may come to contact with it is adversely affected. In addition, the use of more than 30 parts of alkylene glycol alkyl ether would provide no particular increase in efficiency.

With less than 2 parts of an alkanolamine added, its efficiency is poor. On the other hand, with more than 15 parts of an alkanol amine, the resulting detergent composition feels slimy to the touch which offends the users and sometimes results in hand chap, and further increased sudsing is brought about during use, which leads to the unfavourable condition that suds still remain unremoved after draining.

Therefore, in accordance with the present invention 9 to 30 parts of an alkylene glycol ether and 2 to 15 parts of an organic amine are used with respect to 100 parts of the detergent base. Particularly, 15 to 28 parts of an alkylene glycol alkyl ether and 3 to 15 parts of an alkanolamine may be preferably used.

The detergent composition according to the present invention will be further illustrated in terms of the following performance tests in conjunction with the accompanying drawing which is a schematic view of a device for determining sudsing ability.

Test composition

The compositions of the detergent are indicated in Table 4.

Table 4.

| Composition Sample | Detergent base (parts) | Diethanolamine (parts) | Diethylene glycolethyl ester (parts) |
|---|---|---|---|
| W | 100 | 5 | 25 |
| X | 100 | 0 | 0 |
| Y | 100 | 0 | 25 |
| Z | 100 | 5 | 0 |

Permeability test

In this test, the permeation rates of the Samples W, X, Y and Z were determined according to a Canvas Disc Method, ASTM D 2281 – 68. The results are shown in Table 5.

Table 5.

| Sample Concentration | W | X | Y | Z |
|---|---|---|---|---|
| 1.0 % | sec. 7.5 | sec. 10.5 | sec. 9.5 | sec. 9.5 |

The above results indicate that the detergent composition comprising the detergent base to which both an alkylene glycol alkyl ether and an alkanolamine have been added is far superior in permeability to that containing either alkylene glycol alkyl ether or alkanolamine alone.

Detergency test

In this test, the detergency of the Samples W, X, Y and Z were compared to each other with respect to reflectance measurements. The results are shown in Table 6.

Table 6.

| Sample Concentration | W | X | Y | Z |
|---|---|---|---|---|
| 5 ml./180 l. water | 67% | 53% | 53% | 58% |
| 10 " | 72 | 59 | 64 | 58 |
| 15 " | 77 | 59 | 68 | 59 |
| 20 " | 83 | 61 | 72 | 59 |

The above results indicate that the Samples Y and Z containing either an alkylene glycol alkyl ether or an alkanol amine alone are little different from the Sample X comprising only the detergent base with respect to values of reflectance, and, particularly, with a lower concentration of these additives, there are provided no distinctive effects. However, the Sample W containing both of these additives provides excellent effect due to their synergism.

Specific surface tension test

In this test, the surface tension of the Samples W and X were compared with that of water according to the Drop Weight Method. The results are shown in Table 7.

Table 7.

| Sample Concentration | W | X |
|---|---|---|
| 0.1% | 0.67 | 0.79 |
| 0.5 | 0.54 | 0.55 |
| 1.0 | 0.51 | 0.52 |

The above results indicate that the detergent composition comprising both of an alkylene glycol alkyl ether and an alkanolamine added to the detergent base is distinctively effective, particularly at a lower concentration of these additives.

Sudsing test

In this test the sudsing ability of the samples W, X, Y and Z were compared with each other according to the Japanese Industrial Standard JIS K-3362-1970 method, corresponding to ASTM D 1173-53.

This method (JIS, K-3362-1970) is summarized as follows: The device for determing sudsing ability as shown in the accompanying drawing is used wherein the part B is set up vertically and water at a specific temperature is circulated through the outer jacket C by means of a pump, not shown, to maintain the temperature around the part B at a constant value. After fitting a part A to the part B, 50 ml. of a sample solution maintained at the same temperature is gently poured into the part B along the wall of the tube B of inner diameter D of 50 mm while wetting throughout the side walls. Then, 200 ml. of said sample solution is picked up by a pipette of a capacity of 200 ml. and this pipette is secured on the top of the tube B as shown in the drawing and as designated as A. Then a plug at the upper end thereof is opened to cause the sample solution to flow over about 30 seconds so that the liquid drops may be directed to the center of the liquid surface in the part B, the distance L being 900 mm. As soon as all of the solution completely flows out, an amount of suds which is indicated in terms of an average height by eye-measurement in mm. is determined and the mean value of several measurements is calculated to produce an integer which is defined as the sudsing ability. The results are shown in Table 8.

Table 8.

(Condition: Temperature: 40°C, Concentration: 100 PPM)

| Elapsed time(minute) | Sample W | X | Y | Z |
|---|---|---|---|---|
| 0 | 46.8$^{ml.}$ | 33.4$^{ml.}$ | 41.8$^{ml.}$ | 43.4$^{ml.}$ |
| 5 | 36.8 | 25.0 | 23.4 | 39.1 |
| 15 | 33.5 | 21.7 | 16.7 | 26.7 |
| 30 | 20.0 | 20.0 | 16.7 | 25.7 |
| 45 | 16.7 | 18.7 | 15.1 | 11.7 |
| 60 | 10.0 | 13.4 | 15.1 | 10.0 |
| 80 | 8.3 | 10.0 | 10.0 | 8.4 |

The above results indicate that by the addition of an alkylene glycol alkyl ether and an alkanolamine to the detergent base, suds develop heavily at the initial stage of the use and the suds rapidly decrease with the lapse of time. In view of the above facts, it will be noted that the initial sudsing permits the grime to disperse easily and the reduced suds during draining makes a rinsing operation easy.

It will be apparent from the above test results that when an alkylene glycol alkyl ether and an alkanol amine are added to the detergent base as described hereinabove, both materials function synergistically to dissolve insoluble lime soaps characteristic of waxes and scum constituents, and at the same time the detergent composition so obtained provides further reduction in the surface tension at a lower concentration.

In addition, it is one of the requirements for a bathtub cleaner to reduce the residue of the constituents of the detergent to a minimum. That is, when the constituents remain after draining, such remaining constituents, even though they are in a diluted state, exert a harmful effect on the human body and develop a stable foam on the surface of the bath water when the bath is subsequently heated, which makes the users uncomfortable.

The test results shown above indicate that the detergent composition according to the present invention makes it possible to remove the grime from a bathtub only by holding water which contains the composition dissolved therein in the tub without rubbing the tub vigorously as in the case with the conventional detergent composition. In addition, since the present detergent composition may be used in this way, it is possible to clean even the interior of a bath water heater of recirculation type and the connection tube, thereby easily separating the scum adhering to the interior of the bath water heater.

As the detergent composition according to the present invention is a liquid containing no abrasives, it may be used without scratching the surface of the tub. If desired, dyes, perfumes and the like may be added to the detergent composition of the present invention in order to provide it with sensation of cleanness. In addition, a bactericide, an antimold such as chlorinated bisphenols, chlorinated phenols and p-hydroxybenzoate ester may be also added to the present detergent composition. Sequestering agents such as disodium ethylenediaminetetraacetate may be also added.

The use of the detergent composition for a bathtub according to the present invention makes it possible to improve the conventional methods of washing a bathtub, and, as a consequence, the labor of the persons washing the tub may be remarkably reduced.

Furthermore, in accordance with present invention the grime present in the interior of the tub and a bath water heater, which has been hitherto difficult to remove, is easily removed so that the tub can be kept clean. Accordingly, the present invention is believed advantageous from the stand point of sanitation.

The following examples will illustrate the present invention in more detail, but the invention is not limited thereto.

EXAMPLE

Preparation of the composition

An anionic surface active agent, a nonionic surface active agent and an amphoteric surface active agent are added successively to water and to the mixture thus obtained is added an alkylene glycol alkyl ether and an alkanol amine. The mixture is agitated to provide a homogeneous mixture. If desired, a perfume, a dye and the like are added.

Recipe 1

| Composition | Parts by weight |
|---|---|
| Monoethanolamine dodecylbenzenesulfonate | 75.0 |
| Polyoxyethyleneoctylphenolether | 15.0 |
| Miranol J2M-SF Conc. | 10.0 |
| Diethylene glycol monoethyl ether | 9.0 |
| Monoethanolamine | 6.0 |
| Trichlorophenylcarbanilide | 1.5 |
| Water | 183.5 |
| Total | 300.0 |

Recipe 2

| Composition | Parts by weight |
|---|---|
| Diethanolamine lauryl sulfate | 60.0 |
| Polyoxyethyleneoleylalcohol | 32.0 |
| Miranol J2M-SF Conc. | 8.0 |
| Diethylene glycol monoethyl ether | 30.0 |
| n-Butyldiethanolamine | 2.0 |
| Hexachlorophene | 2.0 |

-continued

Recipe 2

| Composition | Parts by weight |
|---|---|
| Disodium ethylenediaminetetraacetate | 2.0 |
| Water | 164.0 |
| Total | 300.0 |

Recipe 3

| Composition | Parts by weight |
|---|---|
| Monoethanolamine dodecylbenzenesulfonate | 110.0 |
| Polyoxyethyleneoctylphenolether | 20.0 |
| Miranol C2M-SF Conc. | 20.0 |
| Ethylene glycol dibutyl ether | 20.0 |
| Diethanolamine | 8.0 |
| Butyl p-hydroxybenzoate | 1.5 |
| Water | 120.5 |
| Total | 300.0 |

In all of the following tests 1, 2 and 3, recipe 1 was used as a sample.

Test 1:

Permeability test (according to the Canvas Disc Method)

With the 1 % aqueous solution, permeability was 9.8 seconds.

Test 2:

Detergency test (according to the reflectance measurement as described above).

The results are shown in Table 9.

Table 9

| Concentration (ml./180 l. water) | Detergency (%) |
|---|---|
| 5 | 72 |
| 10 | 82 |
| 15 | 83 |
| 20 | 91 |

Test 3:

Sudsing ability (according to the JIS K-3362-1970 as described before)

The results are shown in Table 10.

Table 10

(Condition: Temperature: 40°C, Concentration: 100 ppm)

| Lapse time (minute) | Suds amount (ml.) |
|---|---|
| 0 | 50 |
| 5 | 37 |
| 15 | 32 |
| 30 | 27 |
| 45 | 17 |
| 60 | 8 |
| 80 | 0 |

We claim:

1. A detergent composition for bathtub cleaning which consists essentially of:

1. 100 parts by weight of a detergent base comprising 40 to 85% by weight of an alkylaryl sulfonate of the formula:

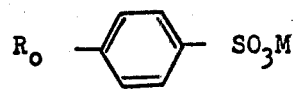

wherein $R_o$ is an alkyl having 8 to 14 carbon atoms, and M is a salt-forming cation selected from the group consisting of ammonia, monoethanolamine, diethanolamine, and triethanolamine; 10 to 40% by weight of a polyoxyethylene alkylaryl ether of the formula:

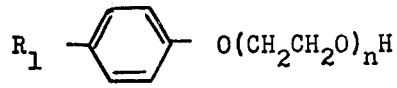

wherein $R_1$ is an alkyl having 8–9 carbon atoms, and n is an integer from 7 to 13; and 5 to 20% by weight of a cyclic imidinium compound of the formula:

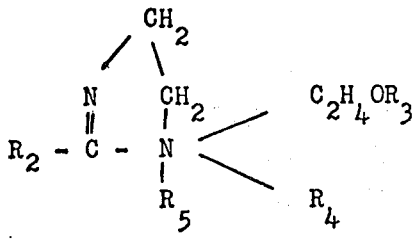

wherein $R_2$ is an aliphatic hydrocarbon having 7 to 17 carbon atoms, $R_3$ is selected from the group consisting of hydrogen, alkali metals, $CH_2COOH$, $CH_2COONa$, and $CH_2COOK$, $R_4$ is a member selected from the group consisting of $CH_2COOH$, $CH_2COONa$, and $$CH_2\underset{\underset{OH}{|}}{C}H\ CH_2SO_3Na,$$

and $R_5$ is a member selected from the group consisting of OH, $$C_{11}H_{23}CO\overset{\overset{CH_3}{|}}{N}\ CH_2COO,$$

$C_{12}H_{25}OSO_3$, and $C_{13}H_{27}(OC_2H_4)_3OSO_3$;

2. 9 to 30 parts by weight of a diethylene glycol monoalkyl ether of the formula:

$$R_6O(C_2H_4O)_2H$$

wherein $R_6$ is a lower alkyl having 1 to 4 carbon atoms, and 3. 2 to 15 parts by weight of an ethanolamine of the formula:

$$(HOCH_2CH_2)_nNH_m$$

wherein $n$ is an integer from 1 to 3 and $m$ is a number satisfying the equation $n + m = 3$;

4. sufficient amount of water to provide an aqueous solution of the mixture of the components (1) through (3), said detergent composition requiring little scrubbing in the bathtub cleaning.

2. A detergent composition for bathtub cleaning as claimed in claim 1 wherein $R_0$ is $C_{12}$.

3. A detergent composition for bathtub cleaning as claimed in claim 1 wherein $R_1$ is $C_9$ and n is equal to 10.

4. A detergent composition for bathtub cleaning as claimed in claim 1 wherein is $CH_2COONa$, $R_4$ is $CH_2COONa$ and $R_5$ is OH.

5. A detergent composition for bathtub cleaning as claimed in claim 1 wherein $CH_2COONa$, $R_4$ is

6. A detergent composition for bathtub cleaning as claimed in claim 1 wherein $n$ is equal to 3 and $m$ is equal to 0.

* * * * *